US012485469B2

(12) United States Patent
Deuser et al.

(10) Patent No.: US 12,485,469 B2
(45) Date of Patent: Dec. 2, 2025

(54) REDUCING MATERIAL USAGE AND PLASTIC-DEFORMATION STEPS IN THE MANUFACTURE OF ALUMINUM CONTAINERS

(71) Applicant: Anheuser-Busch, LLC, St. Louis, MO (US)

(72) Inventors: Brad Deuser, St. Louis, MO (US); Scott Kellerman, St. Louis, MO (US); Mark Schremmer, St. Louis, MO (US); Willie Daies, St. Louis, MO (US); Craig Buschkoetter, St. Louis, MO (US)

(73) Assignee: Anheuser-Busch, LLC, St. Louis, MO (US)

( * ) Notice: Subject to any disclaimer, the term of this patent is extended or adjusted under 35 U.S.C. 154(b) by 283 days.

(21) Appl. No.: 17/017,440

(22) Filed: Sep. 10, 2020

(65) Prior Publication Data

US 2021/0069770 A1 Mar. 11, 2021

Related U.S. Application Data

(60) Provisional application No. 62/898,542, filed on Sep. 10, 2019.

(51) Int. Cl.
*B21D 51/24* (2006.01)
*B21D 22/28* (2006.01)

(52) U.S. Cl.
CPC ..... *B21D 51/24* (2013.01); *B21D 22/28* (2013.01)

(58) Field of Classification Search
CPC ..... B21D 51/24; B21D 51/16; B21D 51/26; B21D 51/2638; B21D 51/2615;
(Continued)

(56) References Cited

U.S. PATENT DOCUMENTS 5,704,240 A * 1/1998 Jordan ..... B21D 15/04 72/103
5,718,352 A * 2/1998 Diekhoff ..... B21D 51/26 215/44

(Continued)

FOREIGN PATENT DOCUMENTS

CN 103786943 A 5/2014
EP 4017661 A1 6/2022

(Continued)

OTHER PUBLICATIONS

Translation of JP-2008057030-A (Year: 2008).*

(Continued)

*Primary Examiner* — Christopher L Templeton
*Assistant Examiner* — Teresa A Guthrie
(74) *Attorney, Agent, or Firm* — Pillsbury Winthrop Shaw Pittman LLP

(57) ABSTRACT

Provided is a process of making an aluminum bottle, the process including: obtaining sheet aluminum, the sheet aluminum having a difference between ultimate tensile strength and yield strength between 3.31 thousand pounds per square inch (ksi) and 8.0 ksi, and the sheet aluminum having a yield strength between 33.1 ksi and 42 ksi; cutting a blank from the sheet aluminum; plastically deforming the blank into a cup with three or fewer drawing steps; and necking the cup to form an aluminum bottle with a neck.

20 Claims, 3 Drawing Sheets

(58) Field of Classification Search
CPC .... B21D 22/28; B21D 35/005; B21D 26/053; B65B 3/02; Y10T 428/13; Y10T 428/12736; Y10T 428/12229; C22C 21/00; C22C 2202/00
USPC ..... 72/339; 53/452, 558; 428/34.1; 220/906; 420/528
See application file for complete search history.

(56) References Cited

U.S. PATENT DOCUMENTS

| | | | | |
|---|---|---|---|---|
| 5,778,723 | A | 7/1998 | Diekhoff | |
| 7,805,970 | B2 | 10/2010 | Woulds | |
| D739,731 | S | 9/2015 | Jones | |
| D739,732 | S | 9/2015 | Jones | |
| 10,022,773 | B2 | 7/2018 | Rouns et al. | |
| 2008/0229801 | A1 | 9/2008 | Woulds | |
| 2008/0302799 | A1 | 12/2008 | Moore et al. | |
| 2011/0114128 | A1 | 5/2011 | Nakagawa et al. | |
| 2012/0043294 | A1 | 2/2012 | Dick et al. | |
| 2014/0000333 | A1 | 1/2014 | Farnham | |
| 2014/0298641 | A1 | 10/2014 | Siles et al. | |
| 2015/0101382 | A1 | 4/2015 | Selepack | |
| 2015/0314361 | A1 | 11/2015 | Rouns et al. | |
| 2016/0083825 | A1 | 3/2016 | Herve et al. | |
| 2016/0256910 | A1* | 9/2016 | Niec | B21D 26/049 |
| 2016/0368650 | A1* | 12/2016 | Davis | B65D 23/02 |
| 2017/0008656 | A1* | 1/2017 | Go | C22F 1/04 |
| 2017/0050232 | A1 | 2/2017 | Schremmer et al. | |
| 2017/0320637 | A1 | 11/2017 | Jones et al. | |
| 2018/0009022 | A1 | 1/2018 | Thomas et al. | |
| 2018/0282848 | A1* | 10/2018 | Iwamura | C22F 1/05 |
| 2019/0031388 | A1 | 1/2019 | Ross et al. | |
| 2019/0368020 | A1* | 12/2019 | Campbell | C22F 1/04 |

FOREIGN PATENT DOCUMENTS

| | | | | | |
|---|---|---|---|---|---|
| JP | 2007-153376 | A | | 6/2007 | |
| JP | 2008057030 | A | * | 3/2008 | |
| JP | 2011084775 | A | | 4/2011 | |
| WO | 2007015560 | A1 | | 2/2007 | |
| WO | WO-2019058935 | A1 | * | 3/2019 | C22C 21/06 |
| WO | 2021050746 | A1 | | 3/2021 | |

OTHER PUBLICATIONS

Machine translation of WO 2019/058935 (Year: 2019).*
International Search Report and Written Opinion in related international application No. PCT/US2020/050226 dated Dec. 17, 2020 (11) pages.
International Preliminary Report on Patentablity in related international application PCT/US2020/050226 dated Mar. 24, 2022, pp. 1-8.
European Application No. 20864092.0, extended European Search Report dated Aug. 18, 2023.
Canadian Application No. 3,150,844, Office Action dated Dec. 15, 2023.
Preliminary Office Action for Brazilian Application No. BR112022004472-0 dated Apr. 15, 2025, pp. 1-5 (incuding informal translation).

* cited by examiner

REDUCING MATERIAL USAGE AND PLASTIC-DEFORMATION STEPS IN THE MANUFACTURE OF ALUMINUM CONTAINERS

CROSS-REFERENCE TO RELATED APPLICATIONS

This patent claims the benefit of U.S. Provisional Pat. App. 62/898,542, titled REDUCING MATERIAL USAGE AND PLASTIC-DEFORMATION STEPS IN THE MANUFACTURE OF ALUMINUM CONTAINERS, filed 10 Sep. 2019. The entire content of each afore-mentioned patent filing is hereby incorporated by reference for all purposes.

BACKGROUND

1. Field

The present disclosure relates generally to aluminum containers and, more specifically, the reduction material usage and plastic-deformation steps in the manufacture of aluminum containers.

2. Description of the Related Art

Aluminum containers have a variety of uses. Examples include recyclable beverage containers, like aluminum cans and aluminum bottles. Other examples include reusable aluminum containers for liquids, like re-usable water bottles, canteens, and the like. In some cases, aluminum containers are used to contain pressurized gasses, like in aerosol cans.

SUMMARY

The following is a non-exhaustive listing of some aspects of the present techniques. These and other aspects are described in the following disclosure.

Some aspects include a process of making an aluminum bottle, the process including: obtaining sheet aluminum, the sheet aluminum having a difference between ultimate tensile strength and yield strength between 3.31 thousand pounds per square inch (ksi) and 8.0 ksi and the sheet aluminum having a yield strength between 33.1 ksi and 42 ksi; cutting a blank from the sheet aluminum; plastically deforming the blank into a cup with three or fewer drawing steps; and necking the cup to form an aluminum bottle with a neck.

Some aspects include a bottle made with the above process.

BRIEF DESCRIPTION OF THE DRAWINGS

The above-mentioned aspects and other aspects of the present techniques will be better understood when the present application is read in view of the following figures in which like numbers indicate similar or identical elements.

Figure 1:
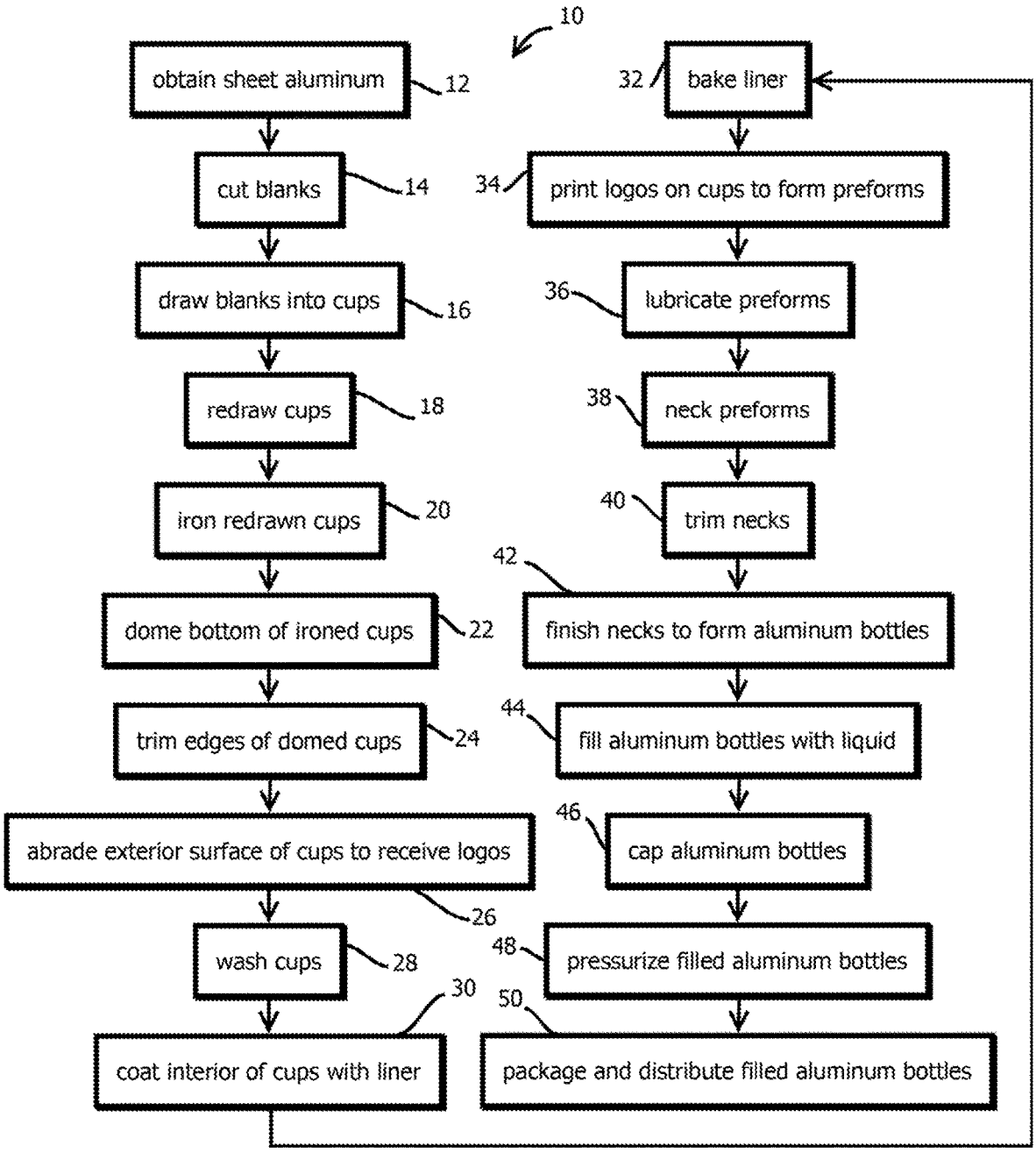
FIG. 1 is a flow chart illustrating some embodiments of a method of manufacturing a container that holds liquids, in accordance with some embodiments of the present techniques.

While the present techniques are susceptible to various modifications and alternative forms, specific embodiments thereof are shown by way of example in the drawings and will herein be described in detail. The drawings may not be to scale. It should be understood, however, that the drawings and detailed description thereto are not intended to limit the present techniques to the particular form disclosed, but to the contrary, the intention is to cover all modifications, equivalents, and alternatives falling within the spirit and scope of the present techniques as defined by the appended claims.

DETAILED DESCRIPTION OF CERTAIN EMBODIMENTS

To mitigate the problems described herein, the inventors had to both invent solutions and, in some cases just as importantly, recognize problems overlooked (or not yet foreseen) by others in the fields of metallurgy and container manufacturing. Indeed, the inventors wish to emphasize the difficulty of recognizing those problems that are nascent and will become much more apparent in the future should trends in industry continue as the inventors expect. Further, because multiple problems are addressed, it should be understood that some embodiments are problem-specific, and not all embodiments address every problem with traditional systems described herein or provide every benefit described herein. That said, improvements that solve various permutations of these problems are described below.

Aluminum containers are more expensive to manufacture than is desirable. Contributors to cost include the amount of aluminum used per container and the number of plastic deformation steps used to make aluminum containers. Reducing the amount of material has been found to reduce yield, and consolidating plastic-deformation operations into fewer steps has been found to have similar issues. Often, the material splits when deformed too severely, and this is aggravated by many aluminum container designs have particularly severe aspect ratios and complex shapes. The challenge is particularly acute for aluminum bottles, which often have a larger aspect ratio than cans and involve more extensive plastic deformation of the metal to form frusto-conical necks accounting for more than 15% of the container's height. Greater work-hardening involved in transforming blanks into high-aspect ratio containers is believed to increase the risk of fractures in distal portions of the workpiece, e.g., at a brim roll near the lip of a bottle's neck. Thus, there is a need for a lower-cost, less-material-intensive process that makes aluminum containers with acceptable yield in fewer steps than are typically performed.

Some embodiments of a manufacturing process described below construct aluminum containers from a particular type of aluminum that has been found to consume less material and use fewer plastic-deformation steps for a given process yield. The type of aluminum, in some embodiments, exhibits a particular range of spread between yield strength and ultimate tensile strength in sheet aluminum (e.g., starting stock, off a coil). This type of aluminum is expected to produce aluminum containers with acceptable yield while using fewer plastic deformation steps, less material, and attaining a thinner side-wall thickness than traditional approaches. For example, an aluminum sheet with a spread in the range of 3.31 to 8.0 ksi (thousand pounds per square inch) and a yield strength in the range of 33.1 to 42 ksi is expected to facilitate production of bottle containers with fewer drawing steps (e.g. two steps instead of three) without worsening rejection rates (e.g., rejection rates may be less than 10%, like less than 5%, such as less than 3%) relative to what is attained with traditional approaches.

An example process consistent with these techniques is described below with reference to FIGS. 1 and 2, and an embodiment of a resulting container is described below with reference to FIG. 3. Embodiments are described with reference to aluminum bottles having dimensions similar to beer bottles, as such containers are among the more difficult to manufacture. But the techniques are expected to be applicable to other shapes and other use cases, e.g., aluminum cans, aerosol cans, re-usable water bottles, pressure vessels, and the like.

As shown in FIG. 1, in some embodiments, the process 10 may begin with obtaining rolls of aluminum sheets, as indicated by block 12. In some embodiments, the container is made from pure aluminum. In some other embodiments, the container is made from aluminum alloys, wherein alloying elements such as copper, magnesium, manganese, silicon, tin and zinc are used. The term "aluminum" herein includes both pure aluminum and alloys thereof.

In some embodiments, the sheets are laid out and cut (e.g., punched) into blanks, as indicated by block 14. The blanks, in some embodiments, have a disk shape, e.g., a right-circular cylinder with a height to diameter ratio of less than 1/10. In some embodiments, the diameter of the blank is between 2-10 inches, between 6-7 inches, like approximately 6.510 inches (e.g., a mean diameter of two orthogonal measurements). In some embodiments, the blank has a thickness of 0.0120 inches to 0.0197 inches, like 0.0160 inches to 0.0180 inches (e.g., based on a mean of caliper measurements at the center of each quadrant). In some embodiments, the blanks may be cut in a pattern that is configured to reduce material waste. For instance, blanks may be arrayed in a hexagonal packing. In some embodiments, all blanks cut from the sheet may be the same size, or some embodiments may array different blacks of different sizes (e.g., feeding different manufacturing lines) on the same sheet to attain even higher packing efficiency.

In some embodiments, the aluminum sheet, as obtained off the reel, at room temperature, before deformation, or while in the blank state, is specified may the manufacturer as having a spread (i.e., the arithmetic difference between) between yield strength and tensile strength in the range of 3.21 to 8.00 ksi, e.g., 3.31 to 8 ksi, 3.3 to 7 ksi, 3.4 to 4.4 ksi, 3.5 to 6 ksi, or 3.6 to 5 ksi. In some embodiments, the aluminum sheet has a yield strength in the range of 33.1 to 42.0 ksi or 32 to 36 ksi. In some embodiments, the spread (e.g. 3.31-8.00 ksi) of the aluminum sheet is expected to facilitate manufacturing containers while consuming less material and fewer plastic deformation steps than is attainable with other approaches. Spread, tensile strength, and yield are determined with commercial standards. In the event that such a commercial standard is not available, material properties may be determined a contact extensometer according to ASTM D638. Tensile strength is used as shorthand herein for ultimate tensile strength. Generally, yield strength is the stress at which material begins to deform plastically, and tensile strength is where the material breaks, as defined in the relevant testing protocols used in the sheet aluminum manufacturing industry.

Predicting process yield from bottle shape and material properties is challenging, but based on empirical experience, processes based on aluminum with lower-spreads are not expected to afford the benefits discussed above. The stress-strain curve of aluminum generally characterizes the materials behavior with respect to yield, tensile strength, and thus spread. The shape of that curve is also indicative of the amount of plastic deformation a material undergoes before fracture. The curve's shape varies between different types of aluminum, and the tradeoff between desirable properties of the curve's shape and spread is not straightforward in relevant regimes. Further, idiosyncratic aspects of the bottle geometry and localized work hardening introduce further complexity into efforts to predict process yields from such bulk-material properties. But it has been observed that spreads lower than 3.31 ksi do not produce all of the benefits discussed above, while materials with higher spreads are expected to yield such benefits. And yield strengths in the range of 33.1 to 42 ksi are expected to achieve higher columnar strength (for axial loads along a central axis of bottles and intermediate stage workpieces) to allow running at thinner top wall thicknesses for future reductions in material usage.

It is expected that, with these material selections, the blank size may be reduced relative to previous processes, which is expected to facilitate changing the cup size and eliminating one or more redraw steps typically used. The reduction in diameter of the blank is expected to reduce the stress at the outer circumference of the blank during plastic deformation, which ultimately becomes the curl of the bottle. This curl experiences the highest stress of the process then as it is formed from the largest circumference of the blank, drawn, ironed, necked, and then curled into the final shape. By reducing the circumference, and eliminating one draw step, it is expected that some embodiments will reduce the amount of stress the curl experiences. The way failures typically manifest is in a split curl defect or expander split defect. In these scenarios, the metal that makes up the curl exceeds the tensile strength of the metal and tears as it is rolled over, or the metal that makes up the curl splits as it is expanded for the thread portion. This allows embodiments to increase the yield strength and loosen the spread, which are design considerations with larger diameter blanks and triple draw processes. Moving to a double draw process is also facilitated by the smaller blank size. Contrary to the industry standard "rule of thumb" not to exceed 40% diameter reduction within a single draw operation, some embodiments draw at 40.5% blank to cup, then 40.1% cup to container.

In some embodiments, the blanks may be drawn into cups, as indicated by block 16. Drawing involves plastic deformation of the blank in a manner that changes (or forms) the inner diameter of a resulting cup. The blanks may be placed into a drawing die and deformed up and around a cylinder, e.g., with an impact extrusion press, to form into a cup. Cups may have a generally concave shape, as discussed below with reference to FIG. 2. The extrusion press, in some embodiments, includes a blank holder, a press shaft, and a cylindrical die, e.g., with a chamfered distal end to impart such a shape on the bottom of the cup and reduce localized strain concentrations in the cup. In some embodiments, the drawing rate is around 40% in the first drawing step.

In some embodiments, the cup is redrawn, as indicated by block 18. The cup may be redrawn in a redraw die to form a taller cup with narrower wall thickness. Redrawing may be performed with an impact extrusion press. This further increase the aspect ratio of height of the cup to the diameter of the cup. In some embodiments, the drawing rate is around 40% in the second drawing step. In some embodiments, the redrawing step also reduces the internal diameter of the cup. The number of redraws is expected to depend on several factors including the thickness, temper, and formability of the metal, coatings on the metal, the diameter of the cone top and the neck portion thereon, and the diameter of the threaded neck to be formed. In some embodiments, two drawing steps (e.g. 16 and 18) are performed before ironing to produce an intermediate work-piece suitable to achieve a container with the dimensions discussed below with FIG. 3. In some other embodiments, 3 drawing steps (e.g. 16, 18 and again a redrawing similar to step 18) are performed before ironing. In some other embodiments, more than 3 drawing steps are performed before ironing.

In some embodiments, the cup is ironed, as indicated by block 20. Ironing may be performed by forcing the cup through an ironing ring, which may have a smaller inner diameter than an outer diameter of the cup, but a larger diameter than an inner diameter of the cup. The cup may be placed on another cylindrical die to place the sidewall of the cup in compression and shear the sidewall when passed through the ironing ring. These forces may plastically deform the cup to thin the sidewall and further increase the height of the cup. The aspect ratio of the cup may change, while the inner diameter of the cup may remain generally constant during this ironing step. Ironing, in some embodiments, reduces the side wall thickness of the cup. In some embodiments, a plurality (e.g., 2, 4, or 6) of ironing steps are performed until the desired wall thickness is achieved.

In some embodiments, the bottom of the ironed cups are domed to form preforms, as indicated by block 22. Redrawn cups may be punched on the bottom using a doming tool to form a dome. The doming tool may have complementary shaped die that operate on opposing surfaces of the bottom of the cup. Doming, in some embodiments, help reducing the amount of aluminum needed to stand a desired amount of pressure. In some embodiments, the dome has a concave shape with a circular perimeter. A diameter of the dome's perimeter may be between 50 and 95% of that of the preform. In some embodiments, the dome is a spherical cap having a height less than one quarter of the diameter of the sphere. In some embodiments, the diameter of this sphere is bigger than the diameter of the preform. In some embodiments, the dome has an axis of rotational symmetry that is coaxial with a centerline (e.g., an axis of rotational symmetry) of the preform.

In some embodiments, the top edges of the preforms (e.g., straight-wall containers) may be trimmed, as indicated by block 24. The top edges of the cup may have protruding areas after the redrawing steps. In some embodiments, the jagged edges of the top of the can may be trimmed. In some embodiments, the trimming is performed with a carbon knife. In some embodiments, or less than the top 5%, 10%, or 20% of the preform (by mass) is cut to remove the jagged edges.

In some embodiments, the preforms are brushed or otherwise abraded on the exterior, as indicated by block 26. Abrasion may prepare the preforms for printing, e.g., logos, copy, and other art work. In some embodiments, the brushing is performed with a rolling brush. Abrading may increase a root-mean-square surface roughness measured with a profilometer by more than 10%, like more than 50%, relative to an RMS roughness measured before abrading. In some cases, abrading is achieved by etching (e.g. chemical etching with ferric chloride or nitric acid) the containers, e.g., during a washing step.

The preforms may be washed, as indicated by block 28. In some embodiments, the washing step is performed with water and various other chemicals. In some embodiments, the water may be heated. In some embodiments, washing may remove hydrophobic components attached to the preforms. In some embodiments, washing step may take place in multiple steps (which is not to suggest that other steps must be unitary). The preforms may be first washed with a liquid containing various types of surfactants (e.g. soap) and solvents. Then, the preforms may be washed with only a solvent (e.g. water) to remove the residuals of dirt, particulates, and surfactants.

In some embodiments, logos may be printed on the preforms, as indicated by block 34. In some cases, the logos are printed on the exterior of the preforms. In some embodiments, the printing is performed via a rotating drum that is coated in ink. In some embodiments, the printing may be performed by a lithograph machine, e.g., with different drums applying different colors. In some embodiments, logos are printed with inkjet printing.

The interior of the preforms may be coated with a liner, as indicated by block 30. In some embodiments, the liner is tasteless and nontoxic. In some embodiments, the liner is an epoxy liner. In some embodiments, the liner prevents or impedes mass transfer between the preform walls and the liquid inside the preform. In some embodiments, the liner prevents or impedes leaching of aluminum to the liquid to be into the container. The liner may have a thickness, e.g., ranging from two nanometers to a one millimeter. In some embodiments, the preforms are washed with a chemical that increases the interfacial interaction of the liner with the surface of the preforms. In some embodiments, the liner may be chosen based on the type of liquid that will be distributed in the final bottle. The chemical structure of the liner may be selected to minimize or otherwise reduce interaction with the liquid to minimize various types of interaction (e.g. surface adsorption) between the liner and the liquid packaged in the bottle.

In some embodiments, the liner is baked, as indicated by block 32. Baking may be performed inside an oven at elevated temperatures (e.g. 400 degrees Fahrenheit). The baking process may include multiple steps, each step imparting a particular heat treatment. In some embodiments, the cylindrical preform may be heat treated to mitigate or remove some or all of the work hardening effect incurred at previous steps and to dry or cure sealer applied to the preform.

In some embodiments, preforms are lubricated, as indicated by block 36, prior to necking. In some embodiments, the lubrication is performed to reduce shear applied to the aluminum during the necking process. In some embodiments, the lubrication step may take place at elevated temperatures (e.g. above 50° C., 100° C., or 150° C.).

In some embodiments, the preforms may be necked, as indicated by block 38. Necks may be formed on the top portion of the preforms, opposite the domed end. In some embodiments, the preforms may be necked using a plurality of dies. In some embedments, each necking die may bring the wall gradually inward, imparting a smaller diameter to an outer portion of the preform. In some embodiments, multiple dies are used to shape the neck, each die imparting a narrower diameter to a shorter portion of the top of the preform than the previous die. In some embodiments, the neck has a right frustoconical shape, with generally uniform sidewall thickness. In some other embodiments, frustoconical neck portion transitions to a right-circular cylindrical portion via a fillet or chamfer disposed there between along the height of the container. In some embodiments, increased surf ace roughness reduces the surf ace contact between the necking surface and the container being necked, hence reducing the necking force. In some embodiments, at least some of the dies may be lubricated before being applied on the preforms.

Once the neck is formed, the top portion of the neck may be trimmed, as indicated by block 40. In some embodiments, the trimming is performed with a carbon knife. In some embodiments, more or less than the top 1%, 2%, or 5% (by mass) of the necked preform is removed.

In some embodiments, the necks are finished to form aluminum bottles, as indicated by block 42. In some cases, the top portion of the neck is rolled over itself to form a brim. In some embodiments, the top of the neck is threaded. The resulting aluminum bottle may have the shape discussed below with reference to FIG. 3. In some cases, the bottle is rotationally symmetric about a central axis.

In some embodiments, an annealing step may be performed to further improve formability of the aluminum during the drawing, ironing, or necking steps. In some embodiments, the annealing step is performed at a temperature ranging from 100° C. to 400° C. In some embodiments, the annealing step is performed at a duration ranging from 1 minute to 10 hours. In some embodiments, the annealing step is performed on all parts of the preform or it may be applied locally to a specific portion of the preform.

In some embodiments, the bottles may be filled (e.g., more than 90%, 80%, or 50% of the interior volume occupied) with a liquid, as shown by block 44. In some embodiments, the liquid may be a variety of beverages, like water, sodas, beer, wine, liquor, fruit juice, seltzer, smoothies, kombucha, and the like. In some embodiments, the bottles are filled with a gas, for instance in some aerosol cans. In some cases, the liquid may contain a dissolved gas, like carbon dioxide, which may be released after sealing to pressurize the bottle. In some cases, nitrous oxide may be added to pressurize the bottle and increase its strength.

In some embodiments, the filled bottles are capped, as indicated by block 46. Capping may seal the bottles. In some embodiments, the bottle is pressurized, as indicated by block 48, before sealing the bottle. In some embodiments, the internal pressure of the bottle after pressurizing is in the range of 30-110 psi. In some other embodiments, the internal pressure of the bottle after pressurizing is in the range of 50-100 psi. In some other embodiments, the internal pressure of the bottle after pressurizing is in the range of 60-80 psi. Pressurization can occur as a result of dissolved gasses coming out of solution or by injected gasses, like carbon dioxide or nitrous oxide, for instance.

Once the aluminum bottle is sealed, it may be packaged and distributed, as indicated by block 50. Packaging may include feeding the bottles into a boxing machine operative to package groups of bottles into cardboard boxes. Bottles (or packages thereof) may be palletized and distributed, e.g., to retail stores.

Figure 2:
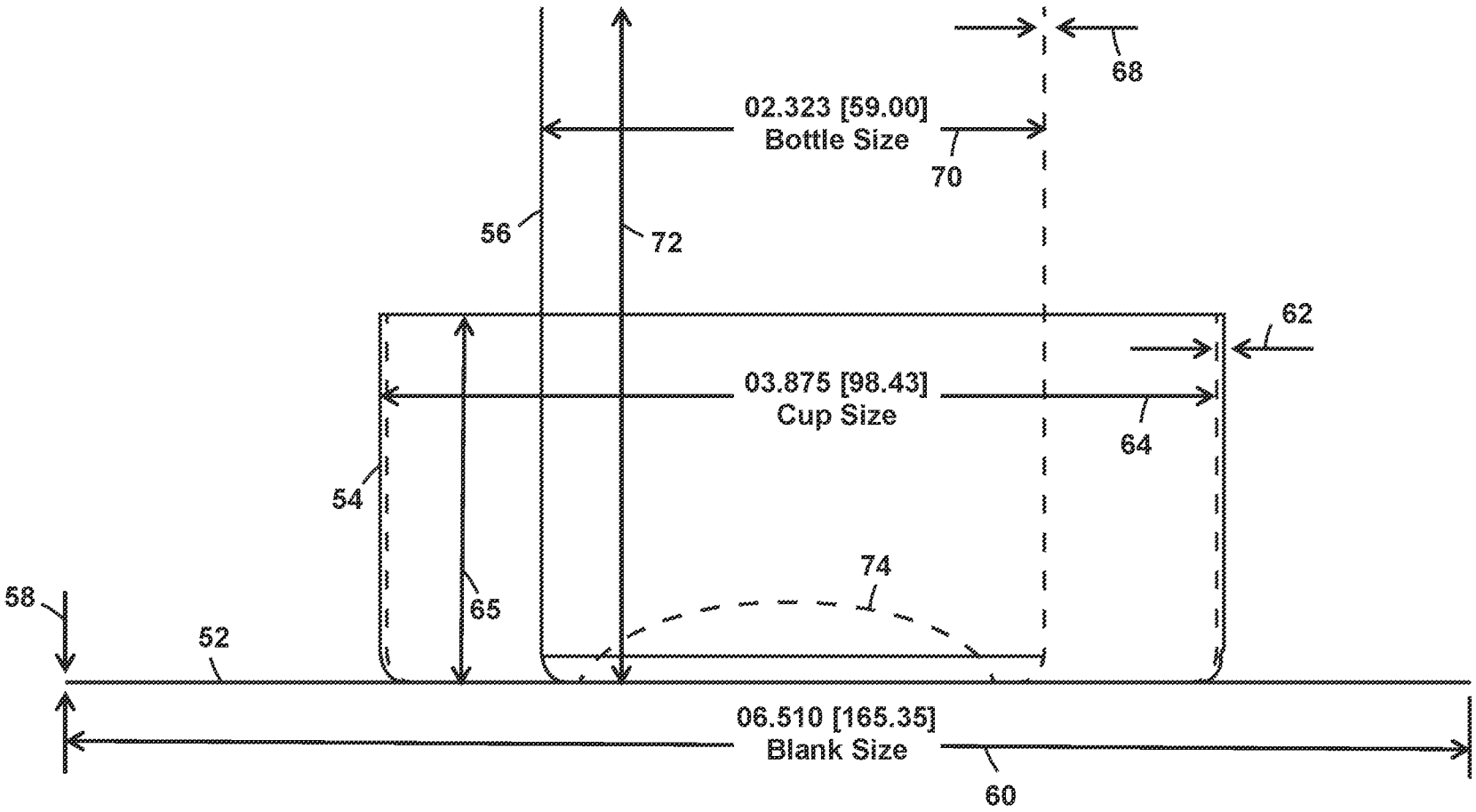
FIG. 2 is a cross sectional elevation view that illustrates various intermediate stages of formation of a container, in accordance with some embodiments of the present techniques.

FIG. 2 is a cross-sectional elevation view that shows the first stages of cups formed with the process of FIG. 1. As indicated, a blank 52 may initially have a thickness 58 and a diameter 60 with the dimensions discussed above.

The blank 52 may be drawn into a cup 54. The cup 54 may have a diameter 64 of 3.875 inches. The cup 54 may have a sidewall thickness 62 that is reduced from the thickness 58. The cup 54 may have a height 65 that is less than that of a subsequent stage.

The cup 54 may be redrawn into cup 56, which may have an interior diameter 70 that is a final interior diameter of a body portion of the resulting container. In some cases, the interior diameter 70 is 2.323 inches. The cup 54 may have a height 72 that is more than 2 or 3 times then diameter 70. The sidewall thickness 68 of the cup 54 may be reduced with subsequent ironing steps. A dome 74 may be formed at the bottom of the cup 54 to reduce the amount of aluminum needed to hold a fluid at a desired pressure (e.g. 100 psi) inside the resulting bottle.

Figure 3:
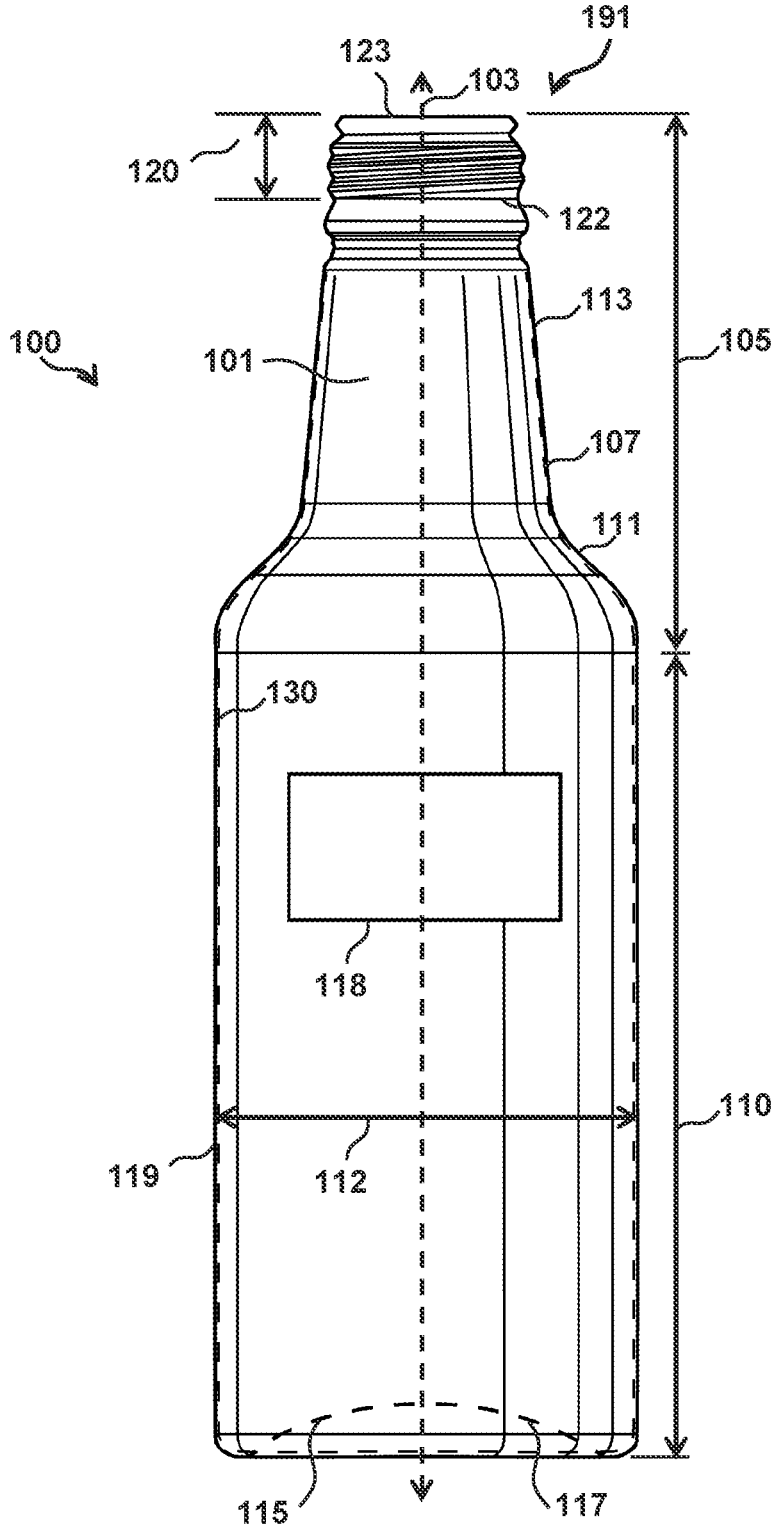
FIG. 3 illustrates a plan view of a container made of an aluminum, in accordance with some embodiments of the present techniques.

FIG. 3 is an elevation view of an example of an aluminum bottle 100 made aluminum 101. Other bottles may have different dimensions. Bottles are distinct from cans in that they have necks. Necks are narrower than a widest diameter by more than 10%, and necks account for more than 15% of the height of the container.

The bottle 100 can be mass-produced from coils of aluminum sheet 101 through a set of blanking, drawing, and ironing processes, like those discussed above with reference to FIG. 1. The container 100 may have a concave bottom portion 115 (or other type of dome), a cylindrical (e.g., right, circular cylinder) body portion 110, and a neck 105 that may have a threaded portion 120. The cylindrical body portion 110 extends from the circular perimeter 117 and maintain essentially a same diameter 112.

In some embodiments, the cylindrical portion 110 has a wall thickness of between about 0.00575 to 0.00800 inches, e.g., 0.00600 and 0.0070 inches, or 0.00640 to 0.00650 inches, like 0.00645 inches+/−0.00020 inches. In some embodiments, the neck portion 105 below the threaded portion may have a sidewall thickness of 0.00585 to 0.00960 inches or 0.00800 to 0.00900 inches, e.g., 0.008200 to 0.00880 inches, like 0.00865 inches+/−0.00020 inches. In some embodiments, the threaded portion 120 may have a sidewall thickness of 0.00850 inches to 0.00950 inches, e.g., 0.00870 inches to 0.00930 inches, like 0.00900 inches+/−0.00020 inches.

The neck portion 105 may be formed near the open end 191 of the bottle 100. The neck portion 105 may have a varying diameter reduced from the uniform diameter 112 of the cylindrical portion 110. The varying diameter may form a tapered profile 107 that gradually constricts the neck portion 105 toward the opening 123. In some embodiments, a shoulder portion 111 of the neck portion 105 extends at an angle of about 45 degrees from the cylindrical portion 110. In some embodiments, a top neck portion 113 of the neck portion 105 extends at an angle of about 6 degrees from a centerline 103 of the bottle 100. In some embodiments, the top neck portion 113 of the neck portion 105 extends at an angle of about 5.75 degrees from the centerline 103 of the bottle 100. In some embodiments, a layer of transparent sealer 119 may further be applied onto the layer of paint. A film of sealer 130 may be applied onto the inner surface of the bottle 100 for separating the drink from the aluminum sheet. The threads 122 may be exposed on the outer surface of the container 100. An art work or logos 118 may be printed on the exterior of the bottle 100.

In some embodiments, the bottle has an aspect ratio (e.g., ratio between maximum height and maximum width) of more than 2 (the ratio of height 110+105 to diameter 112). In some other embodiments, the bottle has an aspect ratio of more than 3. In some other embodiments, the bottle has an aspect ratio of more than 3.5. In some other embodiments, the bottle has an aspect ratio of more than 4.

In some embodiments, the ratio of the height of neck 105 to the height of the cylindrical portion 110 is more than 0.3. In some other embodiments, the ratio of the height of neck 105 to the height of the cylindrical portion 110 is more than 0.4. In some other embodiments, the ratio of the height of neck 105 to the height of the cylindrical portion 110 is more than 0.5. In some other embodiments, the ratio of the height of neck 105 to the height of the cylindrical portion 110 is more than 0.6. In some other embodiments, the ratio of the height of neck 105 to the height of the cylindrical portion 110 is around 0.47.

In some embodiments, the cylindrical portion 110 of the bottle 100 has a height of between about 114 mm or 4.490" and about 162 mm or 6.381". In some embodiments, the cylindrical portion 110 has a height of between about 120 mm or 4.7244" and about 155 mm or 6.1024". In other embodiments, the cylindrical portion 110 has a height of about 162 mm or 6.3779". In some embodiments, the bottle 100 has an overall height of between about 190 mm or 7.48" and about 238 mm or 9.37". In other embodiments, the bottle 100 has an overall height of between about 200 mm or 7.874" and about 220 mm or 8.661". In other embodiments, the bottle 100 can have an overall height up to about 12".

Manufacturing of aluminum containers is expected to have higher rejection rates than rejection rates of traditional cans due to the more complicated geometry of the container and the higher plastic deformation needed for a shape with high aspect ratio of height to diameter (e.g. aspect ratio of 3 and higher) and narrower neck of the container.

Some embodiments produce a metal container with reduced rejection rates associated with the production of aluminum containers. In some embodiments, number of drawing steps are reduced to two, instead of three drawing steps, by decreasing the blank size. In some embodiments, the production method described herein also allows for the production of a container that is taller than previously available aluminum containers. In some embodiments, the production method described herein also allows for a thinner side wall thickness and thus a lower aluminum material usage than previously available. The reduction in diameter reduces the stress at the outer circumference of the blank, which ultimately becomes the curl of the container. This curl experiences the highest stress of during the processing. By reducing the circumference, and eliminating one draw step, the curl experiences a lower stress which results in lower rejection rates.

It should be noted that, in some embodiments, split curl defect and expander split defect are the common type of defects which can be prevented or reduced by reducing the applied stress on the curl. In some embodiments, the curl of the container experiences the highest applied stress during the manufacturing. The part of the aluminum sheet that makes up the curl may tear as it is rolled over or it may split during the expansion for thread portion. In some embodiments, defects at curl are the main cause of container rejection. These defects can be a split curl defect or expander split defect. in some embodiments, the rejection rates are reduced by decreasing the drawing steps from three to two. In some embodiments, the split rate is less than 5%. In some other embodiments, the split rate is less than 2%. In some other embodiments, the split rate is less than 1%. In some other embodiments, the split rate is less than 0.5%. In some other embodiments, the split rate is less than 0.1%.

The reader should appreciate that the present application describes several independently useful techniques. Rather than separating those techniques into multiple isolated patent applications, applicants have grouped these techniques into a single document because their related subject matter lends itself to economies in the application process. But the distinct advantages and aspects of such techniques should not be conflated. In some cases, embodiments address all of the deficiencies noted herein, but it should be understood that the techniques are independently useful, and some embodiments address only a subset of such problems or offer other, unmentioned benefits that will be apparent to those of skill in the art reviewing the present disclosure. Due to costs constraints, some techniques disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such techniques or all aspects of such techniques.

It should be understood that the description and the drawings are not intended to limit the present techniques to the particular form disclosed, but to the contrary, the intention is to cover all modifications, equivalents, and alternatives falling within the spirit and scope of the present techniques as defined by the appended claims. Further modifications and alternative embodiments of various aspects of the techniques will be apparent to those skilled in the art in view of this description. Accordingly, this description and the drawings are to be construed as illustrative only and are for the purpose of teaching those skilled in the art the general manner of carrying out the present techniques. It is to be understood that the forms of the present techniques shown and described herein are to be taken as examples of embodiments. Elements and materials may be substituted for those illustrated and described herein, parts and processes may be reversed or omitted, and certain features of the present techniques may be utilized independently, all as would be apparent to one skilled in the art after having the benefit of this description of the present techniques. Changes may be made in the elements described herein without departing from the spirit and scope of the present techniques as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X'ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Features described with reference to geometric constructs, like "parallel," "perpendicular/orthogonal," "square", "cylindrical," and the like, should be construed as encompassing items that substantially embody the properties of the geometric construct, e.g., reference to "parallel" surfaces encompasses substantially parallel surfaces. The permitted range of deviation from Platonic ideals of these geometric constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct. The terms "first", "second", "third," "given" and so on, if used in the claims, are used to distinguish or otherwise identify, and not to show a sequential or numerical limitation.

In this patent, certain U.S. patents, U.S. patent applications, or other materials (e.g., articles) have been incorporated by reference. The text of such U.S. patents, U.S. patent applications, and other materials is, however, only incorporated by reference to the extent that no conflict exists between such material and the statements and drawings set forth herein. In the event of such conflict, the text of the present document governs, and terms in this document should not be given a narrower reading in virtue of the way in which those terms are used in other materials incorporated by reference.

The present techniques will be better understood with reference to the following enumerated embodiments:

1. A method of making an aluminum bottle, the method comprising: obtaining sheet aluminum, the sheet aluminum having a difference between ultimate tensile strength and yield strength between 3.31 thousand pounds per square inch (ksi) and 8.0 ksi; cutting a blank from the sheet aluminum; plastically deforming the blank into a cup with three or fewer drawing steps; and necking the cup to form an aluminum bottle with a neck.
2. The method of embodiment 1, wherein: the blank is plastically deformed into the cup with two or fewer drawing steps; and the sheet aluminum has a yield strength between 33.1 ksi and 42 ksi.
3. The method of embodiment 1, wherein the aluminum bottle has an aspect ratio of 3 or greater.
4. The method of embodiment 3, wherein the blank is plastically deformed into the cup with two or fewer drawing steps.
5. The method of embodiment 1, wherein the aluminum bottle has an aspect ratio of 3.5 or greater.
6. The method of embodiment 5, wherein the blank is plastically deformed into the cup with two drawing steps.
7. The method of embodiment 1, wherein: the aluminum bottle has an aspect ratio of 4 or greater; and the blank is plastically deformed into the cup with two drawing steps.
8. The method of embodiment 1, wherein: the blank is a disk-shaped blank with a diameter between 2 and 10 inches and a thickness between 0.0120 inches and 0.0197 inches.
9. The method of embodiment 1, wherein: the blank is a disk-shaped blank with a diameter between 6 and 7 inches and a thickness between 0.0160 inches and 0.0180 inches.
10. The method of embodiment 1, wherein: diameters of the cup and of the aluminum bottle are between 2 and 2.5 inches; a height of the aluminum bottle is between 7.48 and 9.37 inches; the aluminum bottle has a cylindrical portion with a wall thickness of between 0.00575 and 0.00800 inches; the aluminum bottle has a weight of between 24 to 27 grams; and the aluminum bottle has a domed bottom with a dome depth of between 0.400 and 1.00 inches.
11. The method of embodiment 1, wherein: the aluminum bottle has a cylindrical portion with a wall thickness of between 0.0060 inches and 0.0070 inches.
12. The method of embodiment 1, wherein: the aluminum bottle has a cylindrical portion with a first wall thickness of 0.00645 inches+/−0.00020 inches; and the neck has a second wall thickness along at least part of the neck of between 0.00800 and 0.00900 inches.
13. The method of embodiment 1, wherein: the aluminum bottle has a cylindrical portion with a first wall thickness of 0.00645 inches+/−0.00020 inches.
14. The method of embodiment 1, further comprising: an annealing step at a temperature of between 100° C. to 400° C. for a duration of between 3 to 30 minutes.
15. The method of embodiment 1, further comprising: shaping a threaded portion on the neck, wherein the threaded portion has a sidewall thickness of between 0.00850 to 0.00950 inches.
16. The method of embodiment 1, further comprising: dispensing a liquid into the aluminum bottle, the bottle being packaging for the liquid.
17. The method of embodiment 16, further comprising: pressurizing the liquid in the aluminum bottle to between 30 and 110 psi.
18. The method of embodiment 1, wherein: the neck has a frusto-conical shape; and a height of the neck accounts for more than 15% of a height of the aluminum bottle.
19. The method of embodiment 1, wherein at least some of the drawing steps have a 35% or greater drawing rate.
20. The method of embodiment 1, wherein each of the drawing steps have a drawing rate of around 40%.

21. The method of embodiment 1 further comprising: coating the cup with an epoxy liner; and baking the epoxy liner at a temperature of between 1 50° C. to 250° C.

22. An aluminum bottle made with the process of any of embodiments 1-21.

What is claimed is:

1. A method of making an aluminum bottle, the method comprising:

obtaining sheet aluminum, the sheet aluminum having a difference between ultimate tensile strength and yield strength between 3.31 thousand pounds per square inch (ksi) and 8.0 ksi and having a yield strength between 33.6 ksi and 42 ksi;

cutting a blank from the sheet aluminum;

plastically deforming the blank into a cup with three or fewer drawing steps; and necking the cup to form an aluminum bottle with a neck.

2. The method of claim 1, wherein:

the blank is plastically deformed into the cup with two or fewer drawing steps.

3. The method of claim 1, wherein the aluminum bottle has an aspect ratio of 3.5 or greater.

4. The method of claim 3, wherein the blank is plastically deformed into the cup with two drawing steps.

5. The method of claim 1, wherein:

the aluminum bottle has an aspect ratio of 4 or greater; and the blank is plastically deformed into the cup with two drawing steps.

6. The method of claim 1, wherein:

the blank is a disk-shaped blank with a diameter between 2 and 10 inches and a thickness between 0.0120 inches and 0.0197 inches.

7. The method of claim 1, wherein:

the blank is a disk-shaped blank with a diameter between 6 and 7 inches and a thickness between 0.0160 inches and 0.0180 inches.

8. The method of claim 1, wherein:

diameters of the cup and of the aluminum bottle are between 2 and 2.5 inches;

a height of the aluminum bottle is between 7.48 and 9.37 inches;

the aluminum bottle has a cylindrical portion with a wall thickness of between 0.00575 and 0.00800 inches;

the aluminum bottle has a weight of between 24 to 27 grams; and the aluminum bottle has a domed bottom with a dome depth of between 0.400 and 1.00 inches.

9. The method of claim 1, wherein:

the aluminum bottle has a cylindrical portion with a first wall thickness of 0.00645 inches+/−0.00020 inches; and the neck has a second wall thickness along at least part of the neck of between 0.00800 and 0.00900 inches.

10. The method of claim 1, wherein:

the aluminum bottle has a cylindrical portion with a first wall thickness of 0.00645 inches+/−0.00020 inches.

11. The method of claim 1, further comprising:

an annealing step at a temperature of between 100° C. to 400° C. for a duration of between 3 to 30 minutes.

12. The method of claim 1, further comprising:

shaping a threaded portion on the neck, wherein the threaded portion has a sidewall thickness of between 0.00850 to 0.00950 inches.

13. The method of claim 1, further comprising:

dispensing a liquid into the aluminum bottle, the bottle being packaging for the liquid.

14. The method of claim 13, further comprising:

pressurizing the liquid in the aluminum bottle to between 30 and 110 psi.

15. The method of claim 1, wherein:

the neck has a frusto-conical shape; and a height of the neck accounts for more than 15% of a height of the aluminum bottle.

16. The method of claim 1, wherein at least some of the drawing steps have a 35% or greater drawing rate.

17. The method of claim 1 further comprising:

coating the cup with an epoxy liner; and baking the epoxy liner at a temperature of between 150° C. to 250° C.

18. The method of claim 1, wherein:

necking the cup comprises steps for necking.

19. The method of claim 1, wherein a first drawing rate of an initial drawing step of the three or fewer drawing steps is greater than 40% and a second drawing rate of a subsequent drawing step of the three or fewer drawing steps is greater than 40%.

20. The method of claim 19, wherein the second drawing rate is a less than the first drawing rate.

* * * * *